US009004428B2

(12) United States Patent
McCalla et al.

(10) Patent No.: US 9,004,428 B2
(45) Date of Patent: Apr. 14, 2015

(54) SERVING TRAY STAND

(71) Applicants: Ross McCalla, Glen Cove, NY (US); Paul Nicotra, Merrick, NY (US); Joseph J. Nina, Massapequa Park, NY (US)

(72) Inventors: Ross McCalla, Glen Cove, NY (US); Paul Nicotra, Merrick, NY (US); Joseph J. Nina, Massapequa Park, NY (US)

( * ) Notice: Subject to any disclaimer, the term of this patent is extended or adjusted under 35 U.S.C. 154(b) by 75 days.

(21) Appl. No.: 13/918,068

(22) Filed: Jun. 14, 2013

(65) Prior Publication Data

US 2014/0367542 A1 Dec. 18, 2014

(51) Int. Cl.
*A47G 23/08* (2006.01)
*A47B 31/00* (2006.01)

(52) U.S. Cl.
CPC ..... *A47G 23/08* (2013.01); *A47B 31/00* (2013.01)

(58) Field of Classification Search
CPC ..... A47B 31/00; A47B 13/14; A47B 5/04; A47B 31/06
USPC ..... 248/175, 302; 211/88.01; 108/97
See application file for complete search history.

(56) References Cited

U.S. PATENT DOCUMENTS 2,846,808 A 8/1958 Ivester
3,100,459 A 8/1963 Liss et al.
3,181,485 A * 5/1965 Dotson et al. ..... 108/97
3,289,615 A * 12/1966 Marschak ..... 108/97
3,301,406 A * 1/1967 Scott ..... 211/88.01
4,099,470 A 7/1978 Cannon, Jr.
D249,108 S 8/1978 Cannon, Jr.
4,218,979 A 8/1980 Esposito et al.
4,548,440 A * 10/1985 Meslin et al. ..... 297/174 CS
D297,695 S 9/1988 Dessart
4,850,282 A 7/1989 Postic
5,070,795 A 12/1991 Redlin et al.
5,285,991 A 2/1994 Carlson
D345,083 S 3/1994 Rosenfield
5,317,977 A 6/1994 Omessi
D356,468 S 3/1995 Beck et al.
5,472,164 A 12/1995 Contee, Jr.
5,609,318 A 3/1997 Scheh
5,894,944 A 4/1999 Swift
6,273,503 B1 8/2001 Cheng

* cited by examiner

*Primary Examiner* — Amy Sterling
(74) *Attorney, Agent, or Firm* — Carter DeLuca Farrell & Schmidt LLP

(57) ABSTRACT

A serving tray stand includes a top portion including a tray rack, and a base portion. The base portion includes at least one leg defining a vertical segment engaged to the tray rack, a horizontal segment extending from the vertical segment, an angled segment extending from the horizontal segment, and an attachment segment extending from the angled segment. The attachment segment of each the at least one legs is disposed in parallel orientation relative to the tray rack and spaced-apart from the tray rack to define a gap therebetween. The gap defined between each attachment segment and the tray rack is configured to receive the tabletop to mount the serving tray stand to the tabletop.

19 Claims, 5 Drawing Sheets

SERVING TRAY STAND

BACKGROUND

1. Technical Field

The present disclosure relates to serving stands and, more particularly, to serving tray stands configured for mounting to a table.

2. Background of Related Art

Efficiently utilizing table space in a restaurant setting provides a more comfortable dining experience for customers, allows more customers to be seated at each table, reduces the overcrowding of tables with plates and serving trays, and/or better accommodates persons requiring special considerations, e.g., children or persons with disabilities. With respect to home dining, efficiently utilizing table space likewise provides the above benefits and also provides additional room for entertainment, e.g., game playing, while dining or snacking. As a result, various different food and drink holders, trays, and stands have been developed in an attempt to more efficiently utilize table space.

SUMMARY

In accordance with embodiments of the present disclosure, a serving tray stand is provided that generally includes a top portion and a base portion. The top portion includes a tray rack. The base portion includes at least one leg defining a vertical segment engaged to the tray rack, a horizontal segment extending from the vertical segment, an angled segment extending from the horizontal segment, and an attachment segment extending from the angled segment. The attachment segment of each the at least one legs is disposed in parallel orientation relative to the tray rack and is spaced-apart from the tray rack to define a gap therebetween. The gap is configured to receive the tabletop to mount (secure, attach, lock, etc.) the serving tray stand to the tabletop.

In embodiments, each of the at least one legs is formed from a single piece of wire stock. Additionally or alternatively, the tray rack may be formed from wire stock.

In embodiments, the top portion further includes at least one retention tab disposed on the tray rack and configured to retain a tray disposed on the tray rack in position thereon.

In embodiments, the top portion may be mounted relative to the tabletop such that the top portion partially overlaps and partially extends from the tabletop.

In embodiments, the attachment segment of each of the at least one legs may further be configured to engage a mounting mechanism secured to the tabletop to mount the top portion to the tabletop.

In embodiments, the horizontal segment of each of the legs may further be configured to stably support the top portion on a tabletop in a position offset above the tabletop.

In embodiments, the serving tray stand may further include an insert releasably engagable with the tray rack to define a support surface extending across the tray rack. Further, the insert may be dimensioned complementary to the tray rack. The insert may additionally or alternatively include a body defining the support surface and a lip extending about an outer periphery of the body for releasably engaging the insert with the tray rack.

Another serving tray stand provided in accordance with embodiments of the present disclosure likewise includes a base portion and a top portion. The base portion includes at least one leg configured to at least one of sit atop a tabletop and mount to the tabletop. The top portion is supported by the base portion and includes a tray rack having a pair of opposed retention members coupled to the tray rack and configured to retain a tray therebetween. At least one retention assembly movably couples at least one of the retention members to the tray rack such that the retention member is movable between a closer position relative to the opposed retention member and a further position relative to the opposed retention member. Each retention assembly includes a biasing member configured to bias the retention member towards the closer position for retaining a tray between the retention members under the bias of the biasing member.

In embodiments, one of the retention members may be coupled to the tray rack via the at least one retention assembly while the other retention member is fixedly engaged to the tray rack. Alternatively, each retention member may be coupled to the tray rack via a retention assembly.

In embodiments, each retention assembly may further include a bolt having a shank secured to the tray rack and a head. The retention member is slidably disposed about the shank of the bolt and the biasing member is disposed about the shank of the bolt between the head of the bolt and the retention member.

In embodiments, the tray rack defines an oval-shaped configuration including a long axis and a short axis. In such embodiments, the retention members may be positioned oppose one another along the long axis of the tray rack.

In embodiments, the tray rack is formed from wire stock.

Another serving tray stand provided in accordance with embodiments of the present disclosure likewise includes a base portion and a top portion. The a base portion includes at least one leg configured to at least one of sit atop a tabletop and mount to the tabletop. The top portion is supported by the base portion and includes a tray rack formed from first and second portions telescopically coupled to one another. The first and second portions are movable relative to one another between a first position, wherein the tray rack defines a first length, and a second position, wherein the tray rack defines a second, different length.

In embodiments, an adjustment assembly configured to releasably lock the first and second portions in a plurality of discrete positions between the first position and the second position is provided. More specifically, the adjustment assembly may include a locking pin coupled to one of the first and second portions and a plurality of spaced-apart apertures defined within the other of the first and second portions. The locking pin is configured for engagement within each of the plurality of spaced-apart apertures for locking the first and second portions in each of the respective discrete positions. Further, the locking pin may be biased into engagement with an aligned one of the plurality of spaced-apart apertures.

In embodiments, another adjustment assembly configured to bias the first and second portions towards the first position may be provided, wherein the first length is smaller than the second length. In such embodiments, the adjustment assembly may include a biasing member interdisposed between free ends of the first and second portions to bias the first and second portions towards the first position.

In embodiments, first and second opposed retention members are coupled to the tray rack with the first retention member coupled to the first portion of the tray rack and the second retention member coupled to the second portion of the tray rack. The first and second retention members are configured to retain a tray between the retention members under the bias of the adjustment assembly.

In embodiments, the serving tray stand may further include first and second inserts dimensioned complementary to the tray rack in the first and second positions, respectively. The first and second inserts are releasably engagable with the tray rack in the respective first and second positions to define a support surface extending across the tray rack.

BRIEF DESCRIPTION OF THE DRAWINGS

Various embodiments of the present disclosure are described with reference to the accompanying drawing figures, wherein.

DETAILED DESCRIPTION

Figure 1A:
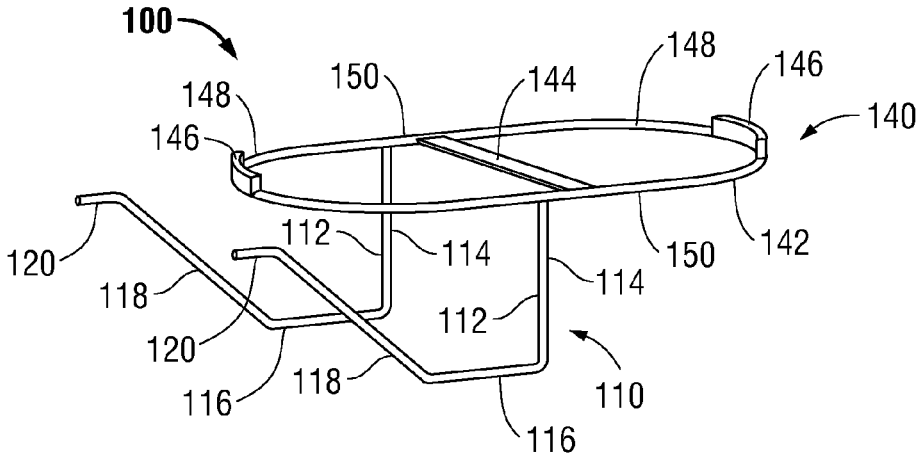
FIG. 1A is a side, perspective view of one embodiment of a serving tray stand provided in accordance with the present disclosure.
Figure 1B:
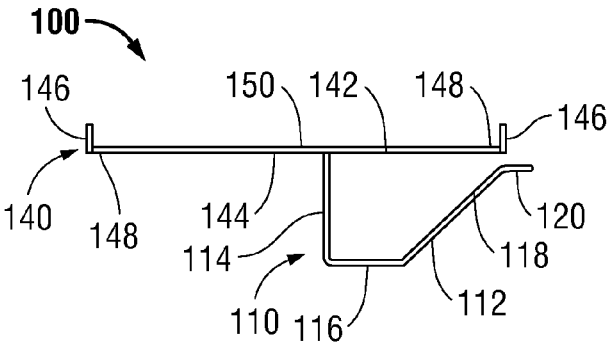
FIG. 1B is a side view of the serving tray stand of FIG. 1A.
Figure 1C:
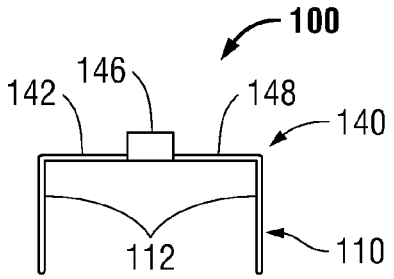
FIG. 1C is an end view of the serving tray stand of FIG. 1A.
Figure 1D:
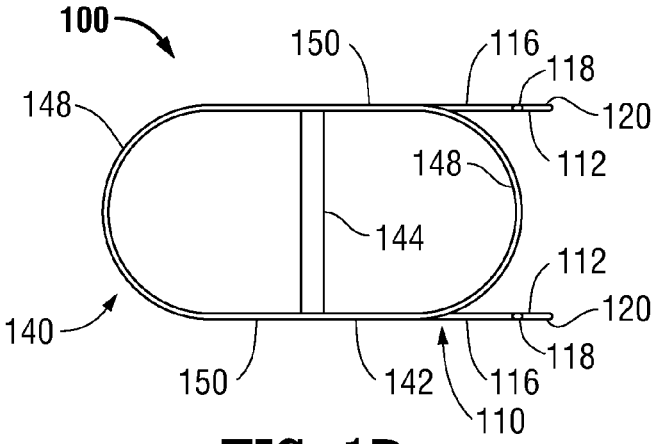
FIG. 1D is a top view of the serving tray stand of FIG. 1A.
Figure 2A:
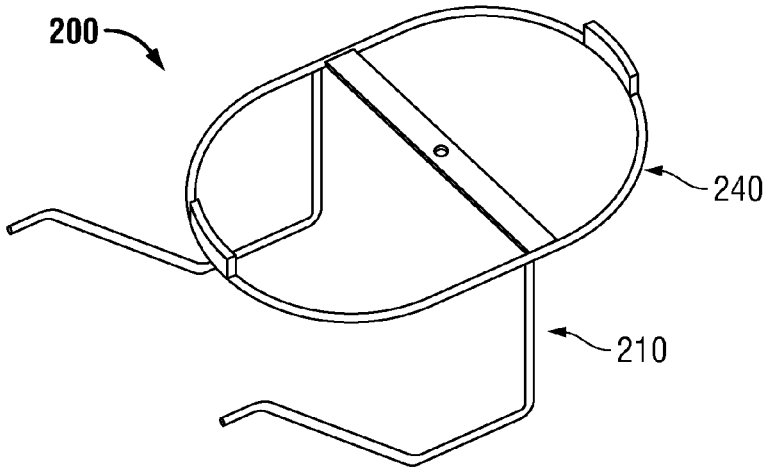
FIG. 2A is a side, perspective view of another embodiment of a serving tray stand provided in accordance with the present disclosure.
Figure 2B:
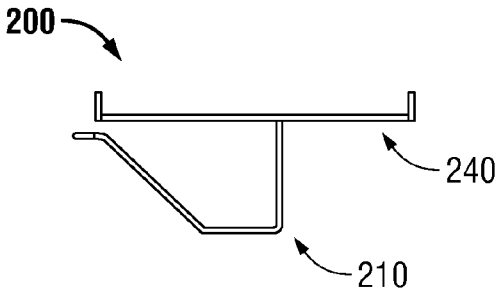
FIG. 2B is a side view of the serving tray stand of FIG. 2A.
Figure 2C:
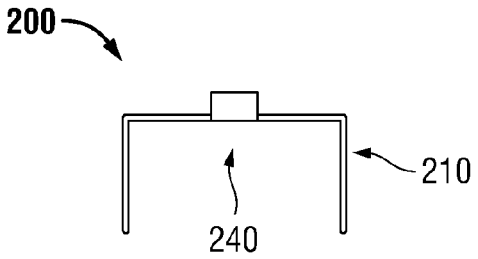
FIG. 2C is an end view of the serving tray stand of FIG. 2A.
Figure 2D:
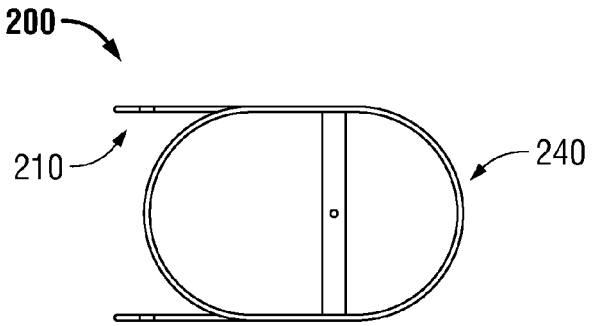
FIG. 2D is a top view of the serving tray stand of FIG. 2A.

Various exemplary embodiments of the presently disclosure are described in detail hereinbelow with reference to the drawings, wherein like references characters identify similar or identical elements.

Turning now to FIGS. 1A-1D, one embodiment of a serving tray stand provided in accordance with the present disclosure is shown generally identified by reference numeral 100. Serving tray stand 100 may be configured to retain and support any suitable plate, dish, or serving tray such as, for example, a pizza tray. Serving tray stand 100 generally includes a base portion 110 and a top portion 140. As will be described in greater detail hereinbelow, base portion 110 is configured to support top portion 140, while top portion 140 is configured to support and retain a serving tray (or other suitable piece of serveware).

As mentioned above, base portion 110 of serving tray stand 100 is configured to support top portion 140 and is further configured for mounting to a table, as will be described in greater detail hereinbelow. Base portion 110 includes a pair of spaced-apart legs 112. Legs 112 are fixedly engaged to top portion 140, e.g., via welding, although legs 112 may alternatively be releasably engaged or otherwise connected to top portion 140. Each leg 112 is formed from a section of wire stock that is bent to define the configuration of the leg 112, although the various segments of leg 112 may alternatively be formed from any suitable material and/or engaged to one another in any suitable manner.

Continuing with reference to FIGS. 1A-1D, each leg 112 includes a substantially vertical segment 114 that extends from top portion 140 and is configured to offset top portion 140 above horizontal segment 116. Horizontal segment 116 extends from vertical segment 114 and includes an angled segment 118 extending from horizontal segment 116 towards top portion 140. An attachment segment 120 extends from angled segment 118 and is configured to engage a table for mounting serving tray stand 100 to the table, as will be described below.

As mentioned above, top portion 140 of serving tray stand 100 is configured to support and retain a serving tray (or other suitable piece of serveware). More specifically, top portion 140 includes a generally oval-shaped rack 142 (although other configurations are also contemplated) configured to support the serving tray, a cross-brace 144 extending across oval-shaped rack 142 in the short-axis direction of oval-shaped rack 142, and a pair of retention tabs 146 opposing one another in the long-axis direction of oval-shaped rack 142. Oval-shaped rack 142 may be formed from one or more sections of wire stock and includes a pair of opposed semi-circular segments 148 interconnected by a pair of substantially parallel linear segments 150. Legs 112 are engaged to and extend from linear segments 150. Cross-brace 144 defines a flat, strip-like configuration and is positioned to inhibit serving trays from accidentally falling through the interior opening defined by oval-shaped rack 142. Cross-brace 144 is engaged to one of linear segments 150 on each end thereof, e.g., via welding or other suitable engagement mechanism.

Continuing with reference to FIGS. 1A-1D, each retention tab 146 is engaged to one of the semi-circular segments 148 of oval-shaped rack 142 such that retention tabs 146 oppose one another along the long-axis of oval-shaped rack 142. Retention tabs 146 are formed as plate-like members that are configured to inhibit a serving tray supported on top portion 140 from sliding off of oval-shaped rack 142. Retention tabs 146 may be welded or otherwise engaged to oval-shaped rack 142 and may be formed from a rigid or semi-rigid material. In some embodiments, retention tabs 146 are coupled to oval-shaped rack 142 via a retention assembly (see FIG. 4) for actively retaining the serving tray in position on oval-shaped rack 142 (as opposed to the passive retention provided by fixed retention tabs 146).

Turning now to FIGS. 2A-2D, another embodiment of a serving tray stand provided in accordance with the present disclosure is shown generally identified by reference numeral 200. Serving tray stand 200 generally includes a base portion 210 and a top portion 240. Base portion 210, similarly as described above with respect to base portion 110 of serving tray stand 100 (FIGS. 1A-1D), is configured for use in both a table-mounted mode and a tabletop mode. In fact, serving tray stand 200 is similar to serving tray stand 100 (FIGS. 1A-1D) except for the dimensions of top portion 240. That is, top portion 240 of serving tray stand 200 may define reduced dimensions such that serving tray stand 200 functions as a "small" serving tray stand 200 configured for retaining relatively small plates, dishes, or serving trays, while serving tray stand 100 (FIGS. 1A-1D) is configured as a "large" serving tray stand 100 (FIGS. 1A-1D) for supporting relatively large plates, dishes, or serving trays on top portion 140 (FIGS. 1A-1D) thereof. Serving tray stand 200 is otherwise similar to serving tray stand 100 (FIGS. 1A-1D) and, thus, will not be described in detail hereinbelow for purposes of brevity.

Figure 3A:
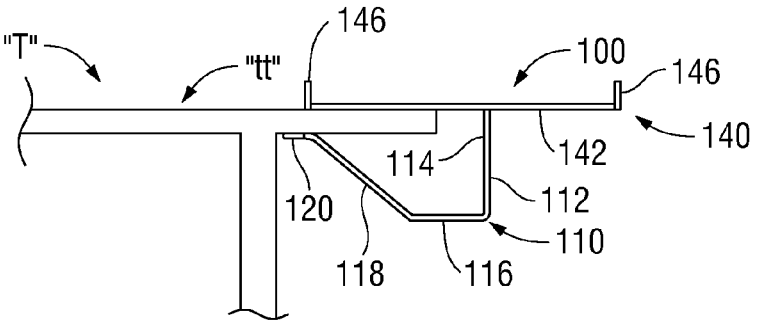
FIG. 3A is a side view of the serving tray stand of FIG. 1A shown mounted to a table according to one embodiment of the present disclosure.

With reference to FIG. 3A, as mentioned above, serving tray stand 100 is configured for mounting to a table, wherein serving tray stand 100 is retained about tabletop "tt" of table "T." More specifically, as shown in FIG. 3A, serving tray stand 100 grasps tabletop "tt" between the upper surfaces of attachment segments 120 of legs 112 of base portion 110 and the lower surface of oval-shaped rack 142 to mount serving tray stand 100 about and adjacent to table "T." As mentioned above, legs 112 are each formed from a section of wire stock that is bent to define the configuration of the leg 112. As a result of this configuration, legs 112 exhibit at least some degree of resilient flexibility. That is, angled segments 118 of legs 112 may be at least partially resiliently deflected relative to horizontal segments 116. Resiliently deflecting angled segments 118 relative to horizontal segments 116 varies the gap distance between attachment segments 120 and oval-shaped rack 142, which are disposed in substantially parallel orientation relative to one another.

In order to mount serving tray stand 100 about and adjacent to table "T," angled segments 118 are resiliently deflected, if necessary, to widen the gap distance between attachment segments 120 and oval-shaped rack 142 sufficiently such that the gap distance is greater than the thickness of tabletop "tt" of table "T." Thereafter, serving tray stand 100 is advanced towards table "T" until tabletop "tt" is received between oval-shaped rack 142 and attachment segments 120. Thereafter, angled segments 118 may be allowed to resiliently return to their at-rest position, if deflection was required, such that tabletop "tt" is frictionally and stably retained between oval-shaped rack 142 and attachment segments 120 under the bias thereof, as shown in FIG. 3A. Alternatively, the gap distance between attachment segments 120 and oval-shaped rack 142 may be dimensioned similar to or slightly larger than the thickness of tabletop "tt," such that serving tray stand 100 is retained in balance about tabletop "tt" without the use of resilient bias.

Continuing with reference to FIG. 3A, when serving tray stand 100 is mounted to tabletop "tt" of table "T," a minor portion of oval-shaped rack 142 rests atop tabletop "tt," while a substantial portion of oval-shaped rack 142 extends outwardly from tabletop "tt" serving as an extension of tabletop "tt" in nearly co-planar relation therewith. This features reduces the amount of table space occupied by serving tray stand 100 while facilitating access to the dish, plate, or tray disposed on serving tray stand 100.

Figure 3B:
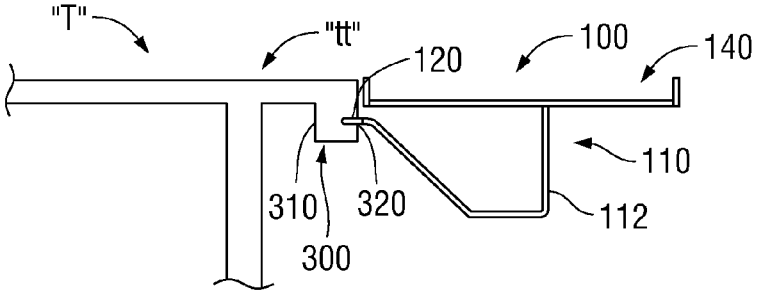
FIG. 3B is a side view of the serving tray stand of FIG. 1A shown mounted to a table according to another embodiment of the present disclosure.

Turning now to FIG. 3B, serving tray may additionally or alternatively be configured to engage table "T" via use of a pair of mounting receptacles 300 (only one of which is shown). In such embodiments, each mounting receptacle 300 includes a housing 310 defining an elongated bore 320 dimensioned to receive one of the attachment segments 120 of base portion 110 of serving tray stand 100, although it is also envisioned that both mounting receptacles be incorporated into a single housing 310. Mounting receptacles 300 may be secured to table "T" via screws, bolts, clamping, latching, adhesion, track-slider engagement, or any other suitable releasable or fixed engagement mechanism. Further, as an alternative to mounting receptacles 300, various other mounting mechanisms, e.g., mounting slots, clamps, brackets, etc., for releasably engaging serving tray stand 100 are also contemplated.

With continued reference to FIG. 3B, once mounting receptacles 300 are secured to table "T," serving tray stand 100 may be engaged to mounting receptacles 300 to thereby mount serving tray stand 100 to table "T." In order to engage serving tray stand 100 to mounting receptacles 300, attachment segments 120 of legs 112 of base portion 110 of serving tray stand 100 are aligned with respective elongated bores 320 of mounting receptacles 300 and serving tray stand 100 is translated towards mounting receptacles 300 until attachment segments 120 of legs 112 are received within elongated bores 320 of mounting receptacles 300. It is envisioned that elongated bores 320 and attachment segments 120 be similarly and sufficiently dimensioned such that serving tray stand 100 is sufficiently retained and supported via mounting receptacles 300. Latching and/or locking structures for securing serving tray stand 100 in engagement with mounting receptacles 300 are also contemplated.

Serving tray stand 100, when mounted to table "T," as shown in FIG. 3B, is positioned such that top portion 140 is positioned adjacent tabletop "tt" of table "T" in near co-planar relation therewith. This configuration allows serving tray stand 100 to function as an extension of tabletop "tt," obviating the need to take up valuable table space and facilitating access to the dish, plate, or tray disposed on serving tray stand 100.

Figure 3C:
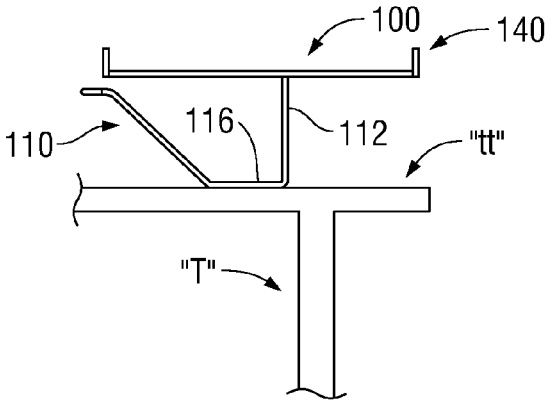
FIG. 3C is a side view of the serving tray stand of FIG. 1A shown sitting on a tabletop in accordance with another embodiment of the present disclosure.

Turning now to FIG. 3C, in the above-embodiments or alternative embodiments, serving tray stand 100 may be configured for use in a tabletop mode. In particular, horizontal segments 116 of legs 112 of base portion 110 of serving tray stand 100 may be configured to stably support serving tray stand 100 on tabletop "tt" of table "T" such that top portion 140 of serving tray stand 100, which supports the serving plate, dish, or tray thereon, is offset above tabletop "tt" of table "T." This configuration frees up valuable table space underneath top portion 140 of serving tray stand 100 by allowing other items, e.g., utensils, plates, drinks, condiments, etc., to be placed on tabletop "tt" underneath top portion 140 of serving tray stand 100.

Figure 4:
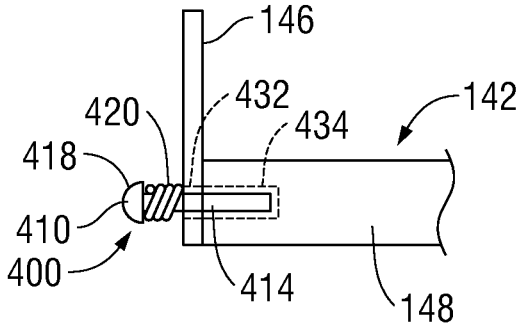
FIG. 4 is a side view of an embodiment of a retention assembly configured for use with the serving tray stands of FIGS. 1A and 2A.

Referring now to FIG. 4, as mentioned above with respect to FIGS. 1A-1D, retention tabs 146 may be coupled to oval-shaped rack 142 via a retention assembly for actively retaining the serving tray in position on oval-shaped rack 142. One embodiment of a suitable retention assembly for this purpose is shown in FIG. 4 and generally identified by reference numeral 400. More specifically, retention assembly 400 is shown operably engaging retention tab 146 to semi-circular segment 148 of oval-shaped rack 142 of top portion 140 of serving tray stand 100, although retention assembly 400 may similarly be used in conjunction with serving tray stand 200 (FIGS. 2A-2D). Further, both retention tabs 146 may be coupled to oval-shaped rack 142 via a retention assembly 400 or only one retention tab 146 may be coupled to oval-shaped rack 142 via retention assembly 400, depending on a particular purpose.

Retention assembly 400 generally includes a bolt 410 and a biasing member 420, e.g., a coil spring. Bolt 410 includes a shank 414 and a head 418. Shank 414 of bolt 410 extends through an aperture 432 defined within retention tab 146 and into engagement within an elongated bore 434 defined within semi-circular segment 148 of oval-shaped rack 142. Shank 414 of bolt 410 may include threading (not explicitly shown) for engaging complementary threading (not explicitly shown) defined on the inner surface of elongated bore 434, or may be otherwise engaged within elongated bore 434 in any suitable fashion. Alternatively, shank 414 of bolt 410 may be welded to semi-circular segment 148 of oval-shaped rack 142.

With continued reference to FIG. 4, in conjunction with FIGS. 1A-1D, biasing member 420 is disposed about shank 414 of bolt 410 and is retained between retention tab 146 and head 418 of bolt 410 in a compressed state such that biasing member 420 urges retention tab 146 towards oval-shaped rack 142. Further, it is envisioned that oval-shaped rack 142 and retention assembly 400 be configured and dimensioned such that, in the biased position, the length of the tray (or other serveware) to be supported and retained on tray support stand 100 is slightly greater than the distance between opposed retention tabs 146 such that retention tab 146 is required to be urged along shank 414 away from oval-shaped rack 142 and against the bias of biasing member 420 in order to accommodate the tray. Once the tray is positioned between retention tabs 146, biasing member 420 urges retention tab 146 into the tray such that the tray is frictionally secured between the retention tabs 146 under the bias of biasing member 420.

Figure 5A:
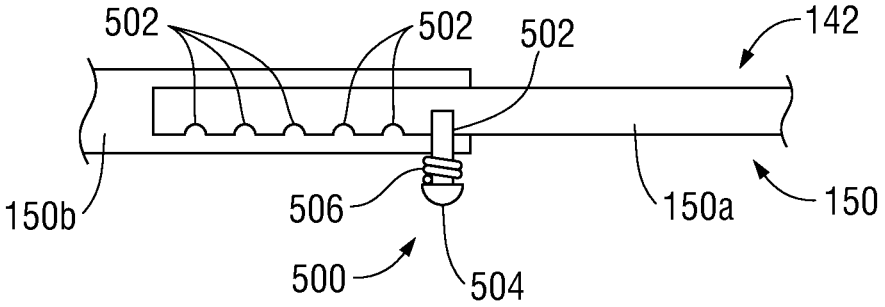
FIG. 5A is a side, partial cross-sectional view of an embodiment of an adjustment assembly configured for use with the serving tray stands of FIGS. 1A and 2A.
Figure 5B:
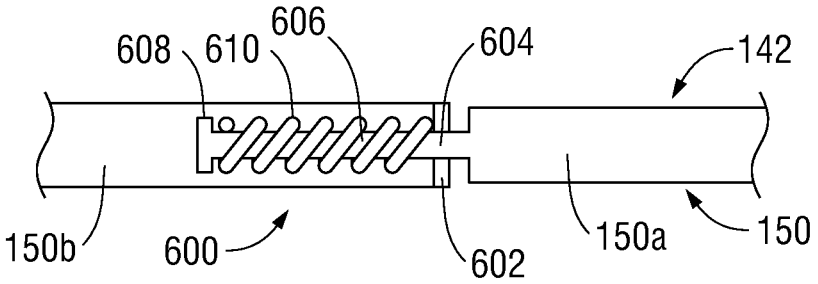
FIG. 5B is a side, partial cross-sectional view of another embodiment of an adjustment assembly configured for use with the serving tray stands of FIGS. 1A and 2A.

Turning now to FIGS. 5A-5B, as opposed to providing a "large" tray support stand 100 (FIGS. 1A-1D) and a "small" tray support stand 200 (FIGS. 2A-2D), tray support stands 100, 200 (FIGS. 1A-1D and 2A-2D, respectively) may alternatively be configured to include an adjustment assembly 500, 600 (FIGS. 5A and 5B, respectively). More specifically, adjustment assemblies 500, 600 are provided to vary the long axis dimension of either or both of tray support stands 100, 200 (FIGS. 1A-1D and 2A-2D, respectively) to accommodate trays (or other serveware) of varying size. For purposes of simplicity, adjustment assemblies 500, 600 will be described in detail with respect to tray support stand 100 (FIGS. 1A-1D) only.

Referring to FIG. 5A, adjustment assembly 500 is shown coupling first and second portions 150*a*, 150*b* of one of the linear segments 150 of oval-shaped rack 142 to one another. Although not shown, the other linear segment 150 may likewise include first and second portions coupled to one another via an adjustment assembly 500. First and second portions 150*a*, 150*b* of linear segment 150 are telescopically arranged relative to one another, e.g., first portion 150*a* is at least partially disposed within and slidable relative to second portion 150*b*. First portion 150*a* further includes a plurality of spaced-apart apertures 502 defined therethrough at pre-determined intervals. A locking pin 504 configured to selectively engage each of apertures 502 extends through an opening defined within second portion 150*b*. Locking pin 504 is biased inwardly into second portion 150*b* via a biasing member 506, e.g., a coil spring. Thus, when locking pin 504 is aligned with one of apertures 502 of first portion 150*a*, biasing member 506 biases locking pin 504 into engagement within the aperture 502 aligned therewith to lock first and second portions 150*a*, 150*b* in fixed position relative to one another. To disengage locking pin 504 and permit relative telescopic movement between first and second portions 150*a*, 150*b*, locking pin 504 is translated outwardly against the bias of biasing member 506. As can be appreciated, a particular long axis dimension of oval-shaped rack 142 can be achieved by engaging locking pin 504 within a corresponding apertures 502 to accommodate a particularly-sized tray (or other serveware). It is also envisioned that visual indicia or markings (not explicitly shown) be provided to indicate the long axis dimension corresponding to each of apertures 502.

With reference to FIG. 5B, adjustment assembly 600 is shown coupling first and second portions 150*a*, 150*b* of one of the linear segments 150 of oval-shaped rack 142 to one another. Although not shown, the other linear segment 150 may likewise include first and second portions coupled to one another via an adjustment assembly 600. First and second portions 150*a*, 150*b* of linear segment 150 are telescopically arranged relative to one another, e.g., first portion 150*a* is at least partially disposed within and slidable relative to second portion 150*b*. Second portion 150*b* further includes an inwardly-extending annular shoulder 602 disposed at the free end thereof that defines a reduced-dimension aperture 604 as compared to the hollow interior of second portion 150*b*. First portion 150*a* includes an elongated extension 606 extending from the free end thereof that is sufficiently small in diameter so as to permit elongated extension 606 to extend through aperture 604 in slidable relation therewith, while the body of first portion 150*a* is too large to pass through aperture 604. Elongated extension 606 includes a cap 608 disposed at the free end thereof and positioned within second portion 150*b*. Cap 608 is dimensioned larger than aperture 604 such that first portion 150*a* is telescopically slidable relative to second portion 150*b* between a first position defining a minimum long axis length of oval-shaped rack 142 wherein the body of first portion 150*a* is positioned adjacent second portion 150*b*, and a second position defining a maximum long axis length of oval-shaped rack 142 wherein cap 608 is positioned adjacent shoulder 602.

Adjustment assembly 600 further includes a biasing member 610, e.g., a coil spring, disposed about elongated extension 606 between cap 608 and annular shoulder 602. In this position, biasing member 610 biases oval-shaped rack 142 towards the first position, e.g., wherein oval-shaped rack 142 defines a minimum long axis length. It is envisioned that oval-shaped rack 142 be dimensioned such that, in the biased first position, the length of the tray (or other serveware) to be supported and retained on oval-shaped rack 142 is slightly greater than the distance between the opposed retention tabs 146 of tray support stand 100 (see FIGS. 1A-1D), such that oval-shaped rack 142 is required to be telescopically expanded against the bias of biasing member 610. Once the tray is positioned between retention tabs 146, oval-shaped rack 142 may be released such that biasing member 610 urges oval-shaped rack 142 towards the first position to thereby frictionally secure the tray between the retention tabs 146 under the bias of biasing member 610.

Figure 6A:
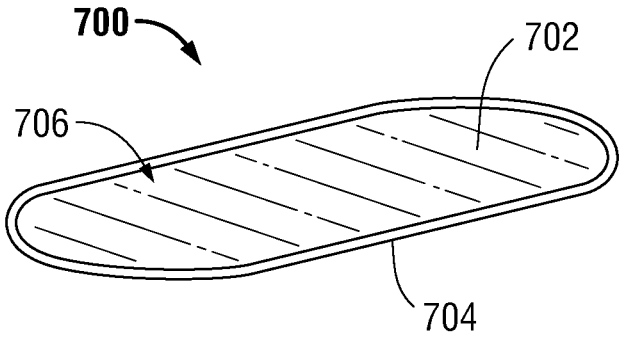
FIG. 6A is a perspective view of an insert configured for releasably engaging the serving tray stand of FIG. 1A.
Figure 6B:
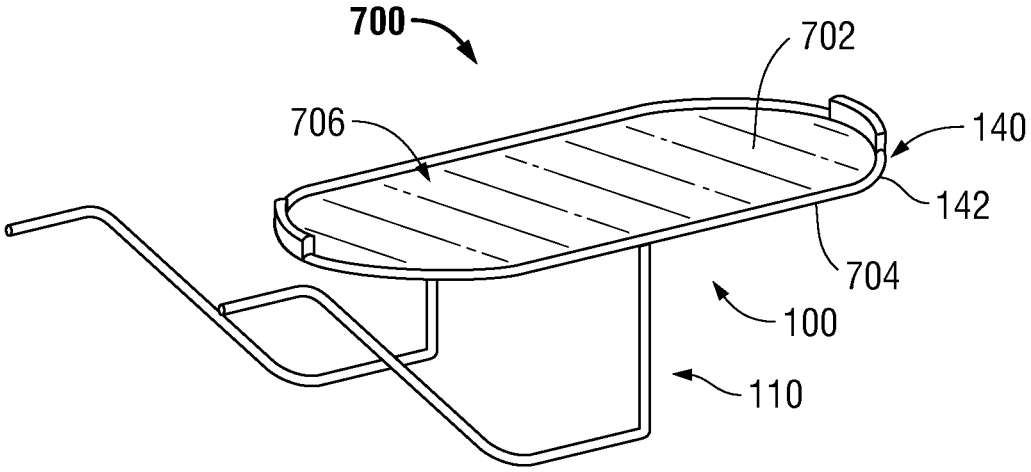
FIG. 6B is a perspective view showing the insert of FIG. 6A engaged with the serving tray stand of FIG. 1A.

Turning now to FIGS. 6A-6B, in conjunction with FIGS. 1A-1D, an insert 700 configured for use with serving tray stand 100 (or any of the other serving tray stands disclosed here) is provided. Insert 700 defines a generally oval-shaped body 702 that is configured and dimensioned complementary to oval-shaped rack 142 of serving tray stand 100. Insert 700 further includes a lip or rim 704 disposed about the outer periphery of oval-shaped body 702 that is configured to receive and/or sit atop oval-shaped rack 142 to facilitate releasable engagement of insert 700 about serving tray stand 100, although it is also envisioned that insert 700 and/or serving tray stand 100 include other suitable features for facilitating releasably engagement therebetween.

With insert 700 retained atop oval-shaped body 702 of serving tray stand 100, as shown in FIG. 6B, insert 700 defines a support surface 706 that extends across and covers the opening defined by oval-shaped rack 142. Support surface 706, as can be appreciated, may be utilized for supporting drinks, smaller plates, condiments, directly supporting food, etc. that would otherwise be incapable of being supported on oval-shaped rack 142. When not needed or not desired for use, insert 700 may simply be removed from serving tray stand, allowing oval-shaped rack 142 to support a serving tray (or other suitable piece of serveware). Further, in embodiments where oval-shaped rack 142 is adjustable, various different incrementally-sized inserts 700 may be provided, for use with oval-shaped rack 142 in its various different size configurations. An adjustable insert 700 for this purpose is similarly contemplated.

The above description, disclosure, and figures should not be construed as limiting, but merely as exemplary of particular embodiments. It is to be understood, therefore, that the disclosure is not limited to the precise embodiments described, and that various other changes and modifications may be effected by one skilled in the art without departing from the scope or spirit of the present disclosure. Additionally, persons skilled in the art will appreciate that the features illustrated or described in connection with one embodiment may be combined with those of another, and that such modifications and variations are also intended to be included within the scope of the present disclosure. Therefore, the above description should not be construed as limiting, but merely as exemplifications of particular embodiments.

What is claimed is:

1. A serving tray stand, comprising:

a top portion including a tray rack; and a base portion including at least one leg, each leg formed from a single piece of wire stock and defining a vertical segment engaged to the tray rack, a horizontal segment extending from the vertical segment, an angled segment extending from the horizontal segment, and an attachment segment extending from the angled segment, the attachment segment of each of the at least one legs disposed in parallel orientation relative to the tray rack and spaced-apart from the tray rack to define a gap therebetween, the gap defined between each attachment segment and the tray rack configured to receive a tabletop to mount the serving tray stand to the tabletop.

2. The serving tray stand according to claim 1, wherein the tray rack is formed from wire stock.

3. The serving tray stand according to claim 1, wherein the top portion further includes at least one retention tab disposed on the tray rack and configured to retain a tray disposed on the tray rack in position thereon.

4. The serving tray stand according to claim 1, wherein the horizontal segment of each of the at least one legs is further configured for stably supporting the top portion on a tabletop in a position offset above the tabletop.

5. The serving tray stand according to claim 1, wherein the top portion is mounted relative to the tabletop such that the top portion partially overlaps and partially extends from the tabletop.

6. The serving tray stand according to claim 1, further comprising an insert engaged with the tray rack to define a support surface extending across the tray rack.

7. The serving tray stand according to claim 6, wherein the insert is dimensioned complementary to the tray rack.

8. The serving tray stand according to claim 6, wherein the insert includes a body defining the support surface and a lip extending about an outer periphery of the body, the lip configured to engage the tray rack to releasably engage the insert with the tray rack.

9. A serving tray stand, comprising:

a top portion including a tray rack formed from wire stock; and a base portion including at least one leg defining a vertical segment engaged to the tray rack, a horizontal segment extending from the vertical segment, an angled segment extending from the horizontal segment, and an attachment segment extending from the angled segment, the attachment segment of each of the at least one legs disposed in parallel orientation relative to the tray rack and spaced-apart from the tray rack to define a gap therebetween, the gap defined between each attachment segment and the tray rack configured to receive a tabletop to mount the serving tray stand to the tabletop.

10. The serving tray stand according to claim 9, wherein each leg is formed from a single piece of wire stock.

11. The serving tray stand according to claim 9, wherein the top portion further includes at least one retention tab disposed on the tray rack and configured to retain a tray disposed on the tray rack in position thereon.

12. The serving tray stand according to claim 9, wherein the horizontal segment of each of the at least one legs is further configured for stably supporting the top portion on a tabletop in a position offset above the tabletop.

13. The serving tray stand according to claim 9, wherein the top portion is mounted relative to the tabletop such that the top portion partially overlaps and partially extends from the tabletop.

14. The serving tray stand according to claim 9, further comprising an insert engaged with the tray rack to define a support surface extending across the tray rack.

15. The serving tray stand according to claim 14, wherein the insert is releasably engagable with the tray rack.

16. A serving tray stand, comprising:

a top portion including a tray rack and at least one retention tab disposed on the tray rack and configured to retain a tray disposed on the tray rack in position thereon; and a base portion including at least one leg defining a vertical segment engaged to the tray rack, a horizontal segment extending from the vertical segment, an angled segment extending from the horizontal segment, and an attachment segment extending from the angled segment, the attachment segment of each of the at least one legs disposed in parallel orientation relative to the tray rack and spaced-apart from the tray rack to define a gap therebetween, the gap defined between each attachment segment and the tray rack configured to receive a tabletop to mount the serving tray stand to the tabletop.

17. The serving tray stand according to claim 16, wherein the top portion is mounted relative to the tabletop such that the top portion partially overlaps and partially extends from the tabletop.

18. The serving tray stand according to claim 16, further comprising an insert engaged with the tray rack to define a support surface extending across the tray rack.

19. The serving tray stand according to claim 16, wherein at least one of the tray rack or each leg is formed from wire stock.

* * * * *